US010219613B2

(12) United States Patent
Annem

(10) Patent No.: US 10,219,613 B2
(45) Date of Patent: Mar. 5, 2019

(54) MAGNETICALLY INDUCED HAIR BRUSH CLEANER SYSTEM AND METHOD OF USING SAME

(71) Applicant: Vidhyasai Annem, Allentown, PA (US)

(72) Inventor: Vidhyasai Annem, Allentown, PA (US)

( * ) Notice: Subject to any disclaimer, the term of this patent is extended or adjusted under 35 U.S.C. 154(b) by 376 days.

(21) Appl. No.: 15/130,981

(22) Filed: Apr. 17, 2016

(65) Prior Publication Data

US 2016/0309887 A1 Oct. 27, 2016

Related U.S. Application Data

(60) Provisional application No. 62/179,026, filed on Apr. 27, 2015.

(51) Int. Cl.

| | |
|---|---|
| ***B08B 7/00*** | (2006.01) |
| ***A46B 17/06*** | (2006.01) |
| ***A45D 24/10*** | (2006.01) |
| *A45D 24/00* | (2006.01) |

(52) U.S. Cl.

CPC ..... *A46B 17/06* (2013.01); *A45D 24/10* (2013.01); *A45D 2024/002* (2013.01); *A46B 2200/104* (2013.01)

(58) Field of Classification Search

CPC ..... A46B 17/06; A46B 2200/104; A45D 2024/002; A45D 24/10; B08B 7/0035

See application file for complete search history.

(56) References Cited

U.S. PATENT DOCUMENTS

| | | | | |
|---|---|---|---|---|
| 4,416,751 | A | 11/1983 | Berkowitz et al. | |
| 4,450,151 | A * | 5/1984 | Shinozawa | A01N 25/06 424/46 |
| 6,112,362 | A | 9/2000 | Parko et al. | |
| 6,408,475 | B1 | 6/2002 | Morrison | |
| 6,421,872 | B1 | 7/2002 | Sciandivasci | |
| 7,225,815 | B2 | 6/2007 | Kung | |
| 7,908,700 | B2 | 3/2011 | DiPippo | |
| 8,910,337 | B2 | 12/2014 | Brackett et al. | |
| 2002/0029749 | A1 | 3/2002 | Berman et al. | |
| 2007/0028937 | A1 | 2/2007 | Holmes | |
| 2008/0229532 | A1 * | 9/2008 | Abodreham | A46B 17/06 15/160 |
| 2009/0000049 | A1 | 1/2009 | Liao | |
| 2010/0236571 | A1 | 9/2010 | Haziza | |
| 2011/0265807 | A1 | 11/2011 | Fasse | |
| 2013/0160785 | A1 * | 6/2013 | Thevenet | A61K 8/0241 132/200 |
| 2013/0291886 | A1 * | 11/2013 | Davis | A45D 8/36 132/275 |

FOREIGN PATENT DOCUMENTS

| | | | | |
|---|---|---|---|---|
| WO | WO-2015059169 A1 * | 4/2015 | | A61K 8/0245 |

* cited by examiner

*Primary Examiner* — Douglas Lee

(74) *Attorney, Agent, or Firm* — James R. McDaniel

(57) ABSTRACT

A method of magnetically induced removal of hair from a brush, wherein the method is comprised of the steps of applying a ferrofluid composition onto a portion of a user's hair; brushing the ferrofluid composition coated hair with a hair brush having a plurality of bristles; placing a magnetized hair brush base having a plurality of openings over the bristles such that the plurality of openings aligns with and interacts with the plurality of bristles such that substantially any of the user's hair that is located within the bristles is attracted towards the magnetized hair brush base; and removing the user's hair from the bristles.

8 Claims, 3 Drawing Sheets

10
16
12
18
20
14

MAGNETICALLY INDUCED HAIR BRUSH CLEANER SYSTEM AND METHOD OF USING SAME

CROSS REFERENCE TO A RELATED APPLICATION

This application is a continuation-in-part of U.S. Patent Application Ser. No. 62/179,026, filed on Apr. 27, 2015. This application is incorporated herein by reference.

FIELD OF THE INVENTION

The present invention relates to a magnetically induced hair brush cleaner and method of using same. More particularly, the present invention relates to a hair brush cleaner that incorporates a magnetic hair brush base along with the application of a novel ferromagnetic suspension to the hair in order to more effectively and efficiently remove the broken hair located within the bristles of hair brush. It was unexpectedly found that a unique composition of ferro-particles, particles that become strongly magnetized in the presence of a magnetic field (ferrofluids), contributed to the solution to more effectively and efficiently remove hair from a hair brush. Ferrofluids are colloidal liquids made of a unique mixture of nanoscale ferromagnetic particles, or ferrimagnetic, particles suspended in a carrier fluid (usually a mineral oil with or without isopropyl alcohol and water). Ferrofluids usually do not retain magnetization in the absence of an externally applied field and thus are often classified as "superparamagnets" rather than ferromagnets. The magnetic hair brush base is situated in such a manner as to effectively and efficiently remove tangled hair strands that were magnetized prior to brushing by causing the magnetized hair strands to move towards the magnetic hair brush base and away from the bristles of the hair brush.

BACKGROUND OF THE INVENTION

The present invention is a unique and useful device to solve the long-term problem, not yet achieved by one skilled in the art, such as disclosed in U.S. Pat. No. 6,408,475, of capturing and removing excess, unwanted hair from a hair brush, so as to not allow the hair to scatter around the area where the hair was being brushed. The proposed device can be applied to human and animal (e.g. dogs and cats) hair without modification.

The accumulation and entanglement of hair in a brush has always been noted as a problem in commercial advertisements, patents, and patent applications associated with the cleaning of a hair brush for more than 50 years. The approach most commonly used is to manually remove the hair from the brush by using one's fingers to pull the hair out; to apply a secondary comb or other instrument to gather and pull the hair out; or adding a netting to gather the hair trapped in the brush and drawing a comb through the brush's bristles and disposing of the excess hair, such as discussed in U.S. Pat. No. 6,112,362.

The practical issues defined have been that if a comb or other instrument is used which has various size pieces (i.e. teeth diameter), at a variety of distances, it can interfere or cause damage to beaded hair brush bristles, thereby breaking the brush and/or the comb. It has been suggested that the hair entrapped in the brush be cut out using scissors to release one end of the hair, thereby making the hair shorter and easier to remove. However, this approach still requires subsequent manual treatment with one's fingers or a comb in order to remove the now shorter hair pieces from the brush bristles (beaded or not).

It is a purpose of this invention to fulfill this and other needs in the art in a manner more apparent to the skilled artisan once, given, the following disclosure.

SUMMARY OF THE INVENTION

A first aspect of the present invention is a method of magnetically induced removal of hair from a brush, wherein the method is comprised of the steps of: applying a ferrofluid composition onto a portion of a user's hair; brushing the ferrofluid composition coated hair with a hair brush having a plurality of bristles; placing a magnetized hair brush base having a plurality of openings over the bristles such that the plurality of openings aligns with and interacts with the plurality of bristles such that substantially any of the user's hair that is located within the bristles is attracted towards the magnetized hair brush base; and removing the user's hair from the bristles.

In one embodiment of the first aspect of the present invention, the magnetized hair brush base includes rare-earth magnetic materials.

In another embodiment of the first aspect of the present invention, the ferrofluid composition includes a ferrofluid.

In another embodiment of the first aspect of the present invention, the ferrofluid is further comprised of a colloidal liquid containing nanoscale ferromagnetic or ferrimagnetic particles suspended in a carrier fluid.

In another embodiment of the first aspect of the present invention, the carrier fluid is further comprised of: mineral oil, isopropyl alcohol and water.

In another embodiment of the first aspect of the present invention, the applying step is further comprised of the step of: spraying the ferrofluid composition onto the portion of the user's hair In another embodiment of the first aspect of the present invention, the ferrofluid composition is further comprised of between 10% and 30%, by concentration, of the ferrofluid relative to the mineral oil.

In another embodiment of the first aspect of the present invention, the ferrofluid composition is further comprised of about 20%, by concentration, of the ferrofluid relative to the mineral oil.

In another embodiment of the first aspect of the present invention, the ferrofluid composition is further comprised of between a 1:15 to 1:2.5 volume ratio of ferrofluid to isopropyl alcohol.

In another embodiment of the first aspect of the present invention, the ferrofluid composition is further comprised of about a 1:2.5 volume ratio of ferrofluid to isopropyl alcohol.

A second aspect of the present invention is a method of magnetically induced removal of hair from a brush, wherein the method is comprised of the steps of: brushing a user's hair with a hair brush having a plurality of bristles; applying a ferrofluid composition onto hair located substantially within the plurality of bristles; placing a magnetized hair brush base having a plurality of openings over the bristles such that the plurality of openings aligns with and interacts with the plurality of bristles such that substantially any of the user's hair that is located within the bristles is attracted towards the magnetized hair brush base; and removing the user's hair from the bristles.

In one embodiment of the second aspect of the present invention, the magnetized hair brush base is further comprised of: rare-earth magnetic materials.

In another embodiment of the second aspect of the present invention, the ferrofluid co position is further comprised of: a ferrofluid.

In another embodiment of the second aspect of the present invention, the ferrofluid is further comprised of a colloidal liquid containing nanoscale ferromagnetic or ferrimagnetic particles suspended in a carrier fluid.

In another embodiment of the second aspect of the present invention, the carrier fluid is further comprised of a unique mixture of: mineral oil, isopropyl alcohol and water.

In another embodiment of the second aspect of the present invention, the applying step is further comprised of the step of: spraying the ferrofluid composition onto the user's hair located substantially within the bristles.

In another embodiment of the second aspect of the present invention, the ferrofluid composition is further comprised of about 20%, by concentration, of the ferrofluid relative to the mineral oil.

In another embodiment of the second aspect of the present invention, the ferrofluid composition is further comprised of about a 1:2.5 volume ratio of ferrofluid to isopropyl alcohol.

In a third aspect of the present invention is a magnetically induced hair brush cleaner, comprising: a ferrofluid composition applicator such that the applicator is capable of applying an amount of a ferrofluid composition onto a portion of a user's hair; a hair brush having a plurality of bristles for brushing the user's hair after the ferrofluid composition has been applied onto a portion of the user's hair, wherein some of the user's hair then becomes located within the bristles; and a magnetized hair brush base having a plurality of openings wherein the plurality of openings align over the bristles and interact with the bristles such that substantially any of the user's hair that is located within the bristles is attracted towards the magnetized hair brush base, wherein the user's hair that was located within the bristles can then be subsequently removed.

In an embodiment of the third aspect of the present invention, the ferrofluid composition is further comprised of: a colloidal liquid containing nanoscale ferromagnetic or ferrimagnetic particles suspended in a carrier fluid.

The preferred magnetically induced hair brush cleaner system and method of using the same, according to various embodiments of the present invention, offers the following advantages: ease of use of the magnetically induced hair brush cleaner system; improved ability to completely remove the entrapped hair located with the bristles of the brush; durability of the magnetically induced hair brush cleaner system; lightness in weight of the magnetically induced hair brush cleaner system; the ability of the magnetically induced hair brush cleaner system to be used on a variety of hair types and styles; the ability of the unique composition having ferro-particles to be easily washed out of the user's hair; the ability to be used on a variety of different types and sizes of brushes and other hair grooming tools; the ability of the ferrofluid composition to properly coat the user's hair; and the ability of the user's hair that has been treated with the unique composition having ferro-particles to be attracted to the magnetic base. In fact, in many of the preferred embodiments, these factors of ease of use of the magnetically induced hair brush cleaner system, improved ability to completely remove the entrapped hair located with the bristles of the brush, durability of the magnetically induced hair brush cleaner system, lightness in weight of the magnetically induced hair brush cleaner system, the ability of the magnetically induced hair brush cleaner system to be used on a variety of hair types and styles, the ability of the unique composition having ferro-particles to be easily washed out of the user's hair, the ability to be used on a variety of different types and sizes of brushes and other hair grooming tools, the ability of the ferrofluid composition to properly coat the user's hair, and the ability of the user's hair that has been treated with the unique composition having ferro-particles to be attracted to the magnetic base are optimized to an extent that is considerably higher than heretofore achieved in prior, known hair brush cleaner systems.

Figures 1A, 1B, 2A, 2B:
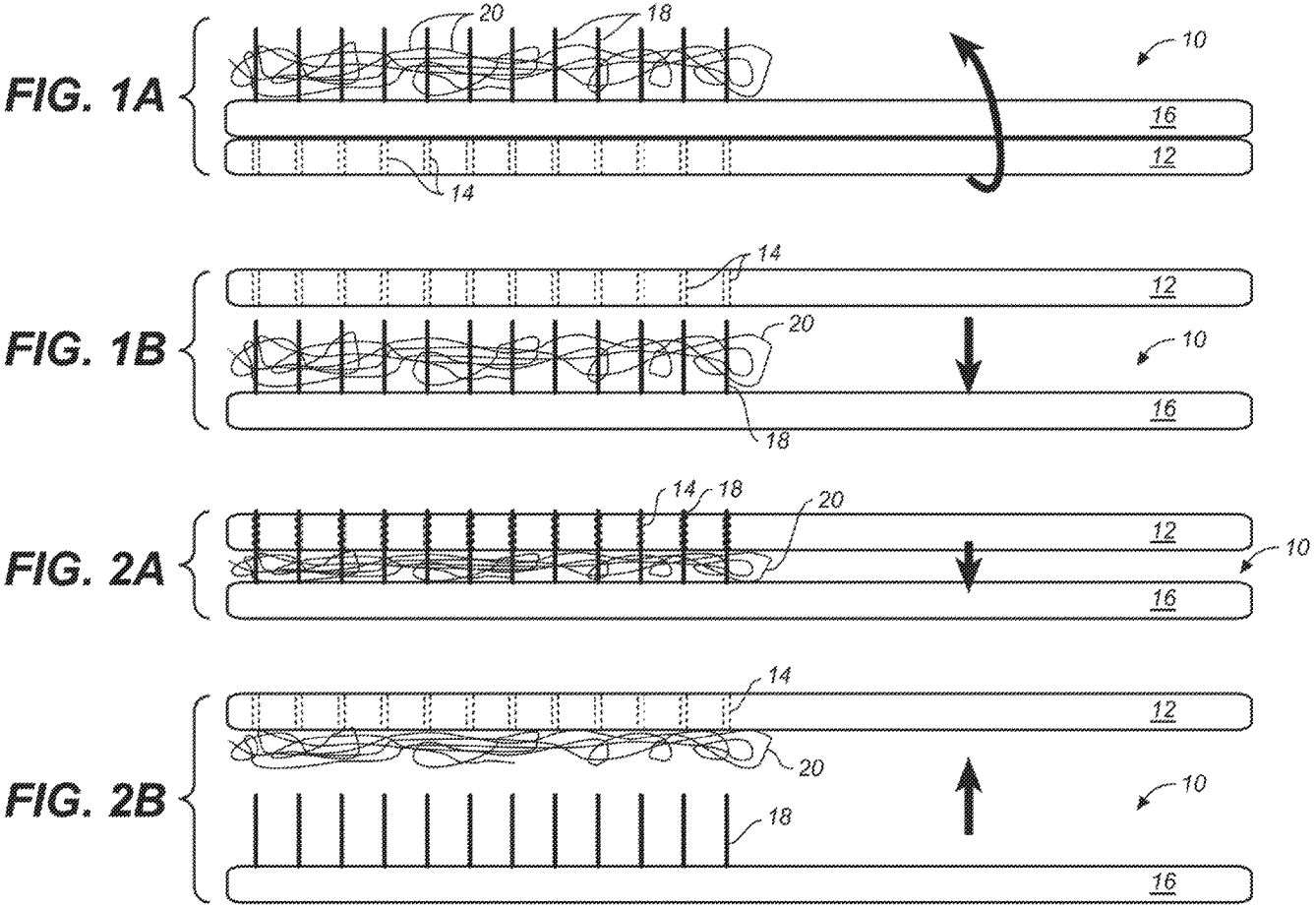
FIGS. 1A and 1B are side views of a magnetically induced hair brush cleaner with the hair being trapped in the hair brush, constructed according to the present invention.
FIGS. 2A and 2B are side views of the magnetically induced hair brush cleaner with the hair being removed from the hair brush, constructed according to the present invention.

The above mentioned features and steps of the invention and the manner of attaining them will become apparent, and the invention itself will be best understood by reference to the following description of the embodiments of the invention in conjunction with the accompanying drawings, wherein like characters represent like parts throughout the several views and in which:

DETAILED DESCRIPTION OF THE INVENTION

Referring now to the drawings and more particularly to FIGS. 1-4, there is illustrated a magnetically induced hair brush cleaner system 10, which is constructed in accordance with the present invention. As will be explained hereinafter in greater detail, the magnetically induced hair brush cleaner system 10 incorporates a magnetic hair brush base along with the application of a novel ferromagnetic suspension to the hair in order to more effectively and efficiently remove the broken hair located within the bristles of hair brush. It was unexpectedly found that a unique composition of ferro-particles (ferrofluids), particles that become strongly magnetized in the presence of a magnetic field, contributed to the solution to more effectively and efficiently remove hair from a hair brush. Ferrofluids are colloidal liquids made of nanoscale ferromagnetic, or ferrimagnetic, particles suspended in a carrier fluid (usually a mineral oil, isopropyl alcohol and water). The magnetic hair brush base 12 is situated in such a manner as to effectively and efficiently remove tangled hair strands that were magnetized prior to brushing by causing the magnetized hair strands to move towards the magnetic hair brush base and away from the bristles of the hair brush. The advantages of magnetically induced hair brush cleaner system 10 are ease of use of the magnetically induced hair brush cleaner system 10, improved ability to completely remove the entrapped hair located with the bristles of the brush, durability of the magnetically induced hair brush cleaner system 10, lightness in weight of the magnetically induced hair brush cleaner system 10, the ability of the magnetically induced hair brush cleaner system 10 to be used on a variety of hair types and styles, the ability of the unique composition having ferro-particles to be easily washed out of the user's hair, the ability to be used on a variety of different types and sizes of brushes and other types of hair grooming tools, the ability of the ferrofluid composition to properly coat the user's hair, and the ability of the user's hair that has been treated with the unique composition having ferro-particles to be attracted to the magnetic base.

Considering now the magnetically induced hair brush cleaner system 10, in greater detail with reference to FIGS. 1-4, the magnetically induced hair brush cleaner system 10 generally includes a magnetic hair brush base 12 and a normal (non-magnetized) hair brush base 16. Preferably, magnetic hair brush base 12 is constructed of a permanent magnet. It is to be understood that the magnetic strength of magnetic hair brush base 12 should be such that it will provide a great enough magnetic strength to cause the user's hair 20 that has been treated with the unique composition having ferro-particles and trapped within the bristles 18 of normal hair brush base 16 to become attracted to magnetic hair brush base 12 and move towards magnetic hair brush base 12, as will discussed in greater detail later.

Considering now magnetic hair brush base 12, in even greater detail with reference to FIGS. 1-4, magnetic hair brush base 12, preferably, is constructed of a magnetic material such as rare-earth type magnets due to their unique strength at the size/mass required. It is possible to use an electromagnet, but due to safety issues of using electrical devices around grounded or ungrounded water pipes, it is not preferred. Also, magnetic base 12 is constructed such that its magnetic strength is great enough to be able to cause the broken hair strands 20 which have been treated with the ferrofluid composition 58 that are located within bristles 18 of brush 16 to become dislodged from the bristles 18 and move towards magnetic hair brush base 12. It is to be further understood that the overall dimensions of magnetic hair brush base 12 should be such that magnetic hair brush base can be easily used to effectively and efficiently remove the hair 20 from the hair brush 16.

With respect to magnetic hairbrush base 12, magnetic hair brush base 12 includes a series of openings or holes 14 which are conventionally formed in magnetic hair brush base 12. It is to be understood that the openings or holes 14 are to be formed into magnetic hair brush base 12 so that they align with the plurality of bristles 18 located on normal hair brush base 16. It is to be further understood that the size or diameter of openings or holes 14 should coincide with the size or diameter of the bristles 18. Consequently, one of the most important features of the present invention is that the magnetically induced hair brush cleaner system 10 can be used on a variety of different sizes and types of hair brushes and other hair grooming tools as long as the size or diameter of openings or holes 14 coincides with the size or diameter of the bristles 18 and the openings or holes 14 align with the plurality of bristles 18 or other such elements on the grooming tool in which the broken hair becomes trapped after being used to groom the hair.

Considering now normal (non-magnetized) hair brush base 16 in greater detail with respect to FIGS. 1-4, preferably, normal (non-magnetized) hair brush base 16 is any conventional hair brush which is another unique feature of the present invention in that a specialized hair brush does not, have to be utilized in order to enjoy the benefits of the present invention. However, it is to be understood that if bristles 18 on normal (non-magnetized) hair brush base 16 contain any type of enlarged tips or balls located on the ends of bristles 18, then these enlarged tips or balls should be conventionally removed so that holes or openings 14 can properly fit over bristles 18. It is to be further understood that while a conventional hair brush 16 is illustrated, the magnetically induced hair brush cleaner system 10 could also be used with conventional hair grooming tools such as a comb, hair pick, hair rollers, hair curlers, hair straighteners or other suitable hair grooming tools.

Considering now the method of using the magnetically induced hair brush cleaner system 10, as shown in FIGS. 1-6, the user 52 conventionally applies a ferrofluid composition or mixture 58 to the user's hair 54 (FIG. 5) using a conventional spraying device 56. It is to be understood that the ferrofluid composition, preferably is composed of colloidal liquids of nanoscale ferromagnetic or ferrimagnetic particles suspended in a carrier fluid such as mineral oil, isopropyl alcohol and water. It is to be understood that an example of a commercially available ferrofluid (Ferrofludic®) is manufactured such as by Ferrotec (USA) Corp. of Bedford, N.H.

Figure 3:
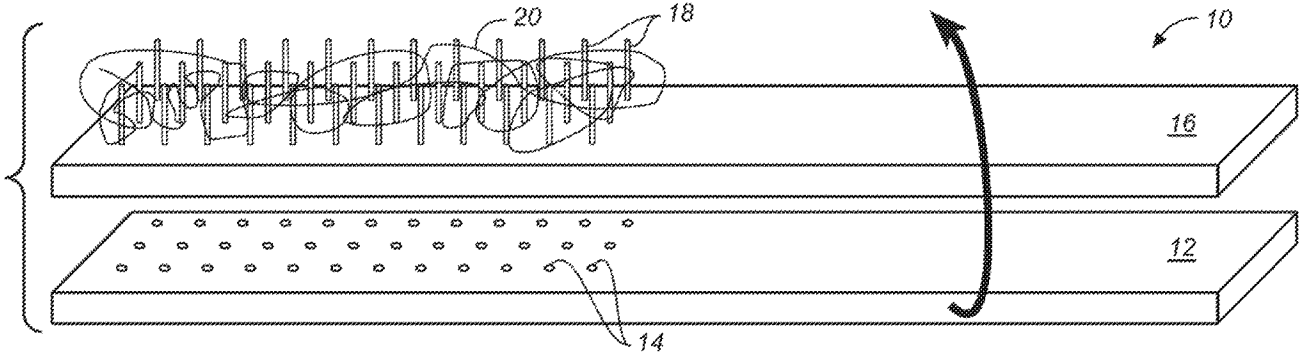
FIG. 3 is a perspective view of the magnetically induced hair brush cleaner with the hair being trapped, in the hair brush constructed according, to the present invention.
Figure 4:
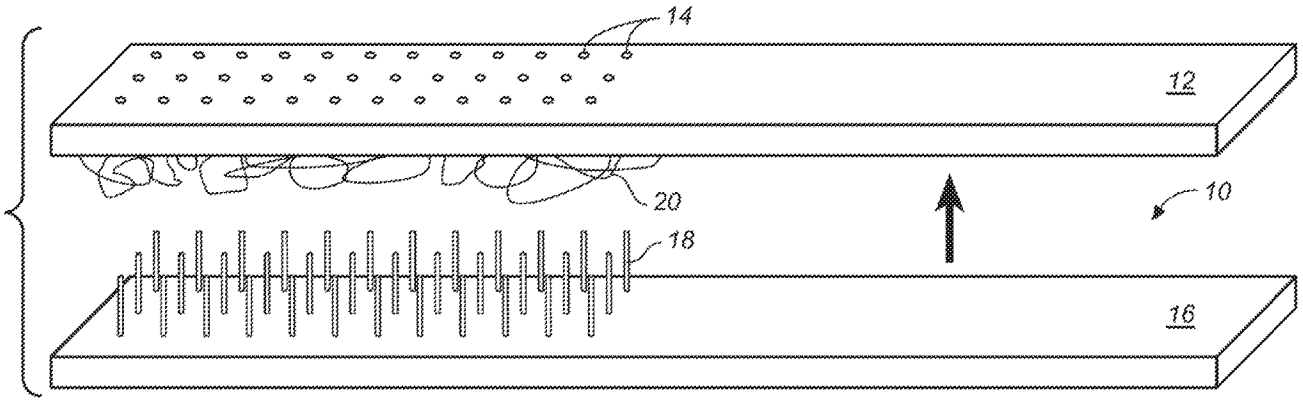
FIG. 4 is a perspective view of the magnetically induced hair brush cleaner with the hair being removed from the hair brush, constructed according to the present invention.
Figure 6:
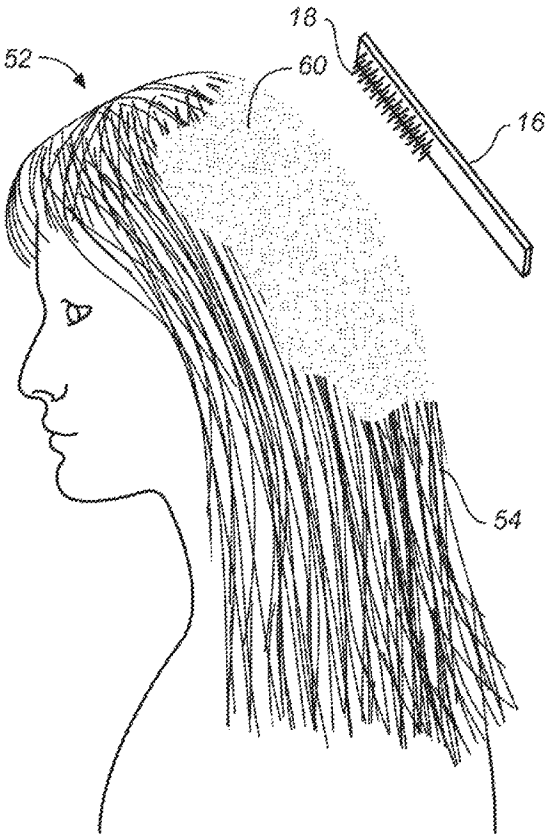
FIG. 6 is a schematic illustration of the user brushing his/her hair after applying the ferromagnetic suspension to the hair, according to the present invention.
Figure 5:
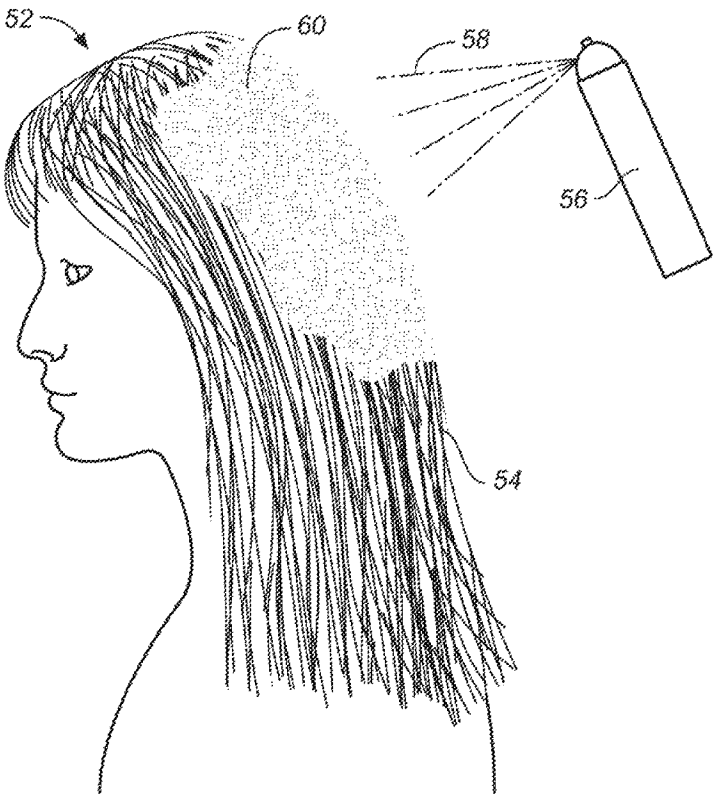
FIG. 5 is a schematic illustration of the user applying the ferromagnetic suspension to the hair, according to the present invention.

After the nanoscale ferromagnetic particle composition 58 is applied, the user 52 conventionally brushes the hair tangles out of the ferrofluid composition or mixture treated hair 60 (FIG. 6) using the normal (non-magnetized) hair brush base 16 as shown in FIG. 6. At this point, the magnetized broken hair 20 is attached to the bristles 18 of normal (non-magnetized) hair brush base 16, as shown in FIGS. 1A and 3.

As best shown in FIGS. 1B, 2A, 2B and 4, magnetic, hair brush base 12 is then located over the bristles 18 of normal (non-magnetized) hair brush base 16 so that magnetized broken hair 20 moves to the top of the bristles 18. The user then removes the magnetic hair brush base 12 from contact with normal (non-magnetized) hair brush base 16 so that the magnetized broken hair 20 can then be easily removed from normal (non-magnetized) hair brush base 16 by conventional techniques, as previously discussed.

In order to prove the efficacy of the present invention the following test results are being provided.

Hair Color Experiment

A test was run to prove that the ferrofluid composition does not alter the visual appearance of different-colored hair strands and the hair strands return to their original/natural physical-chemical properties. To prove this concept, hair was brushed and removed from the brush by means of adding the ferrofluid composition which was measured in grams. To remove the ferrofluid composition, the various hair strands were conventionally washed with water for a timed 30 seconds, and dried for a timed 15 sec. The broken hair strands were compared to the original hair strands and any differences in color or texture were noted. Black, brown, and light auburn human hair were used to conduct the experiment.

The controls included 70° F.+/−° 2 temperature, normal human hair (of different colors), same magnetic hair brush base, and the same concentration of ferrofluid composition (namely, 100%).

The data showed that the presence of the ferrofluid composition did not impact the visual appearance or physical/chemical properties of the hair strands, as the hairs were restored to their original appearance. It was also observed that the color of the ferrofluid composition would wash out along with the iron particles.

Ferrofluid Composition Ratio Experiment

The main objective of this test was to identify the lowest percentage of the ferrofluid composition relative to mineral oil mass that may be used to effectively and efficiently remove hair from a brush. To identify the percentages, an experiment consisting of the removal of hair from a hairbrush by means of a magnetic base using a specific ratio of ferrofluid was conducted. If the hair is attached to the magnetic base at the end of the experiment, there was enough ferrofluid composition mass on the hair to be attracted to the magnetic base, and therefore the hair could be easily removed from brush.

Some controls for the experiment include the temperature of the room 70° F.+/−° 2, original hair strands (colored brown), rinsed hair under warm water (80-85° F.) for a timed 30 seconds, the identical magnetic base, and hair dried for 15 timed seconds.

When conducting this experiment, various ferrofluid compositions of between 10%-100% of the ferrofluid relative to mineral oil were used, From the range of 10% to 100% ferrofluid, the higher the concentration of the ferrofluid, the less volume of ferrofluid was needed to be applied. All mass data was measured with a +/−0.01-gram error limit. It was unexpectedly found that the ferrofluid easily coats the entire hair strand to be lifted by the magnet. Also, the amount of iron particles present in the oil base applied to the hair strands determines the hair's ability to be lifted by the magnetic base. Therefore, the preferred concentration is between 10% and 30% of the ferrofluid relative to mineral oil with the ideal concentration being 20% ferrofluid relative to mineral oil concentration.

Desired Hairbrush Design

As discussed above, it was unexpectedly determined that a conventional hairbrush with no ball to tipped bristles is desired to attain the best results. It was observed that during the experiment, broken hair would latch onto the brush ball tips when being removed from the brush. To prevent this problem, the ball tip pieces on the hairbrush should be conventionally removed or not added to the original brush, so that the hair can be removed more effectively from brush.

Washing Time Experiment

The objective of this experiment was to quantify the time required to remove the applied ferrofluid composition from the hair without effecting the original/natural properties of the hair.

The controlling variables include 70° F.+/−° 2 of the room, 15 timed seconds for drying, auburn colored hair, identical magnetic base and a 100% ferrofluid to mineral oil composition.

Before washing the hair, the broken hair attached to the brush after being treated with the ferrofluid composition was removed from the brush, as discussed above. The broken hair was subjected to different wash times of 5-30 seconds to determine the effective washing time. It was observed that 0.1 grams of hair needed to be washed for at least 10 seconds under water for the visual and magnetic presence of the ferrofluid composition to be removed. When washing the same amount of hair for 5 seconds, the magnetic property of the ferrofluid composition was removed from the hair, but there were dark blotches of an oil base seen in the hair. Therefore, the preferred time is at least 10 seconds.

Ferrofluid Composition Spray Experiment

The purpose of this experiment was to test a ferrofluid composition spray that can be used to remove broken hair from a brush. The researcher mixed four (4) different concentrations of ferrofluid to isopropyl alcohol (91%); a 1:15, 1:7.5, 1:5, and 1:2.5 volume ratio of ferrofluid to isopropyl alcohol (91%). The ferrofluid was first mixed with mineral oil, before adding to the isopropyl alcohol (91%), and the relative alcohol amount was changed to identify the effects on the viscosity of the overall fluid.

The controls for this experiment were 70° F.+/−° 2 temperature of the room, same hair color, a timed 5 second resting time of the fluid base on broken hair, and an identical magnetic base.

Broken hair was placed on the hairbrush and sprayed until the hairs were covered in the ferrofluid composition. The magnetic base was used to pick up the hair, and if the hair strands would not lift the first time, the researcher kept on spraying until they lifted. The volume ratios of 1:7.5 and 1:2.5 lifted the hair the first time the ferrofluid composition was applied, but the volume ratio of 1:5 had to be sprayed twice and 1:15 volume ratio had to be sprayed three (3) times in order for the hair to lift off of the brush. The results showed that the 1:2.5 volume ratio of ferrofluid to isopropyl alcohol (91%) worked the best. Spraying the ferrofluid composition has the primary benefit of removing hair left on a brush after previously removing with the magnetic base, by reapplying the magnetic fluid associated with magnetic base.

Uses of Ferrofluid Spray

The user can use the spray approach, as discussed above, to reapply the iron particles to broken hair in order to more easily remove the broken hair from brush or to simply remove hair from the brush without having to apply the ferrofluid composition to the user's hair. This is yet another unique aspect of the present invention in that the improved removal of hair 20 from the brush 16 can be conducted without applying the ferrofluid composition 58 to the user's hair 54. Directly spraying the brush 16 with the ferrofluid composition 58 decreases the amount of time the user spends on spraying the user's hair 54 with the ferrofluid composition 58, brushing the user's hair 54, and then removing the broken hair 20 from the brush 16 because the user would not have to wash his/her hair. The user merely has to spray the hair 20 located within bristles 18 with the ferrofluid composition 58 and then use the magnetic base 12 to easily remove the broken hair 20 from the brush 16, as discussed above.

The preceding merely illustrates the principles of the invention. It will thus be appreciated that those skilled in the art will be able to devise various arrangements which, although not explicitly described or shown herein, embody the principles of the invention and are included within its spirit and scope. Furthermore, all examples and conditional language recited herein are principally intended expressly to be only for pedagogical purposes and to aid the reader in understanding the principles of the invention and the concepts contributed by the inventors to furthering the art, and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents and equivalents developed in the future, i.e., any elements developed that perform the same function, regardless of structure.

This description of the exemplary embodiments is intended to be read in connection with the figures of the accompanying drawing, which are to be considered part of the entire written description. In the description, relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

All patents, publications, scientific articles, web sites, and other documents and materials referenced or mentioned herein are indicative of the levels of skill of those skilled in the art to which the invention pertains, and each such referenced document and material is hereby incorporated by reference to the same extent as if it had been incorporated by reference in its entirety individually or set forth herein in its entirety.

Applicant reserves the right to physically incorporate into this specification any and all materials and information from any such patents, publications, scientific articles, web sites, electronically available information, and other referenced materials or documents to the extent such incorporated materials and information are not inconsistent with the description herein.

The written description portion of this patent includes all claims. Furthermore, all claims, including all original claims as well as all claims from any and all priority documents, are hereby incorporated by reference in their entirety into the written description portion of the specification, and Applicant(s) reserve the right to physically incorporate into the written description or any other portion of the application, any and all such claims. Thus, for example, under no circumstances may the patent be interpreted as allegedly not providing a written description for a claim on the assertion that the precise wording of the claim is not set forth in haec verba in written description portion of the patent.

The claims will be interpreted according to law. However, and notwithstanding the alleged or perceived ease or difficulty of interpreting any claim or portion thereof, under no circumstances may any adjustment or amendment of a claim or any portion thereof during prosecution of the application or applications leading to this patent be interpreted as having forfeited any right to any and all equivalents thereof that do not form a part of the prior art.

All of the features disclosed in this specification may be combined in any combination. Thus, unless expressly stated otherwise, each feature disclosed is only an example of a generic series of equivalent or similar features.

It is to be understood that while the invention has been described in conjunction with the detailed description thereof, the foregoing description is intended to illustrate and not limit the scope of the invention, which is defined by the scope of the appended claims. Thus, from the foregoing, it will be appreciated that, although specific embodiments of the invention have been described herein for the purpose of illustration, various modifications may be made without deviating from the spirit and scope of the invention. Other aspects, advantages, and modifications are within the scope of the following claims and the present invention is not limited except as by the appended claims.

The specific methods and compositions described herein are representative of preferred embodiments and are exemplary and not intended as limitations on the scope of the invention. Other objects, aspects, and embodiments will occur to those skilled in the art upon consideration of this specification, and are encompassed within the spirit of the invention as defined by the scope of the claims. It will be readily apparent to one skilled in the art that varying substitutions and modifications may be made to the invention disclosed herein without departing from the scope and spirit of the invention. The invention illustratively described herein suitably may be practiced in the absence of any element or elements, or limitation or limitations, which is not specifically disclosed herein as essential. Thus, for example, in each instance herein, in embodiments or examples of the present invention, the terms "comprising", "including", "containing", etc. are to be read expansively and without limitation. The methods and processes illustratively described herein suitably may be practiced in differing orders of steps, and that they are not necessarily restricted to the orders of steps indicated herein or in the claims.

The terms and expressions that have been employed are used as terms of description and not of limitation, and there is no intent in the use of such terms and expressions to exclude any equivalent of the features shown and described or portions thereof, but it is recognized that various modifications are possible within the scope of the invention as claimed. Thus, it will be understood that although the present invention has been specifically disclosed by various embodiments and/or preferred embodiments and optional features, any and all modifications and variations of the concepts herein disclosed that may be resorted to by those skilled in the art are considered to be within the scope of this invention as defined by the appended claims.

The invention has been described broadly and generically herein. Each of the narrower species and sub-generic groupings falling within the generic disclosure also form part of the invention. This includes the generic description of the invention with a proviso or negative limitation removing any subject matter from the genus, regardless of whether or not the excised material is specifically recited herein.

It is also to be understood that as used herein and in the appended claims, the singular forms "a," "an," and "the" include plural reference unless the context clearly dictates otherwise, the term "X and/or Y" means "X" or "Y" or both "X" and "Y", and the letter "s" following a noun designates both the plural and singular forms of that noun. In addition, where features or aspects of the invention are described in terms of Markush groups, it is intended and those skilled in the art will recognize, that the invention embraces and is also thereby described in terms of any individual member or subgroup of members of the Markush group.

Other embodiments are within the following claims. Therefore, the patent may not be interpreted to be limited to the specific examples or embodiments or methods specifically and/or expressly disclosed herein. Under no circumstances may the patent be interpreted to be limited by any statement made by any Examiner or any other official or employee of the Patent and Trademark Office unless such statement is specifically and without qualification or reservation expressly adopted in a responsive writing by Applicants.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

Other modifications and implementations will occur to those skilled in the art without departing from the spirit and the scope of the invention as claimed. Accordingly, the description hereinabove is not intended to limit the invention, except as indicated in the appended claims.

Therefore, provided herein is a new and improved magnetically induced hair brush cleaner system and method of using the same, according to various embodiments of the present invention, offers the following advantages: ease of use of, the magnetically induced hair brush cleaner system; improved ability to completely remove the entrapped hair located with the bristles of the brush; durability of the magnetically induced hair brush cleaner system; lightness in weight of the magnetically induced hair brush cleaner system; the ability of the magnetically induced hair brush cleaner system to be used on a variety of hair types and styles; the ability of the unique composition having ferro-particles to be easily washed out of the user's hair, the ability to be used on a variety of different types and sizes of brushes and other hair grooming tools; the ability of the ferrofluid composition to properly coat the user's hair; and the ability of the user's hair that has been treated with the unique composition having ferro-particles to be attracted to the magnetic base. In fact, in many of the preferred embodiments, these factors of ease of use of the magnetically induced hair brush cleaner system, improved ability to completely remove the entrapped hair located with the bristles of the brush, durability of the magnetically induced hair brush cleaner system, lightness in weight of the magnetically induced hair brush cleaner system, the ability of the magnetically induced hair brush cleaner system to be used on a variety of hair types and styles, the ability of the unique composition having ferro-particles to be easily washed out of the user's hair, the ability to be used on a variety of different types and sizes of brushes and other hair grooming tools, the ability of the ferrofluid composition to properly coat the user's hair, and the ability of the user's hair that has been treated with the unique composition having ferro-particles to be attracted to the magnetic base are optimized to an extent that is considerably higher than heretofore achieved in prior, known hair brush cleaner systems.

I claim:

1. A method of magnetically induced removal of hair from a brush, wherein the method is comprised of the steps of:

brushing a user's hair with a hair brush having a plurality of bristles;

applying a ferrofluid composition onto hair located substantially within the plurality of bristles;

placing a magnetized hair brush base having a plurality of openings over the bristles such that the plurality of openings aligns with and interacts with the plurality of bristles such that substantially any of the users hair that is located within the bristles is attracted towards the magnetized hair brush base; and removing the user's hair from the bristles.

2. The method, as in claim 1, wherein the magnetized hair brush base is further comprised of:

rare-earth magnetic materials.

3. The method, as in claim 1, wherein the ferrofluid composition is further comprised of:

a ferrofluid.

4. The method, as in claim 3, wherein the ferrofluid is further comprised of:

a colloidal liquid containing nanoscale ferromagnetic or ferrimagnetic particles suspended in a carrier fluid.

5. The method, as in claim 4, wherein the carrier fluid is further comprised of:

mineral oil, isopropyl alcohol and water.

6. The method, as in claim 1, wherein the applying step is further comprised of the step of;

spraying the ferrofluid composition onto the user's hair located substantially within the bristles.

7. The method, as in claim 5, wherein the ferrofluid composition is further comprised of about 20%, by concentration, of the ferrofluid relative to the mineral oil.

8. The method, as in claim 5, wherein the ferrofluid composition is further comprised of about a 1:2.5 volume ratio of ferrofluid to isopropyl alcohol.

* * * * *